US006684936B2

(12) United States Patent
Woodson et al.

(10) Patent No.: US 6,684,936 B2
(45) Date of Patent: Feb. 3, 2004

(54) EROSION-RESISTANT COLD-BOX FOUNDRY BINDER SYSTEMS

(75) Inventors: Wayne D. Woodson, Georgetown, IL (US); James J. Archibald, Columbus, OH (US); H. Randall Shriver, Columbus, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 10/120,203

(22) Filed: Apr. 10, 2002

(65) Prior Publication Data

US 2003/0032695 A1 Feb. 13, 2003

Related U.S. Application Data

(60) Provisional application No. 60/283,488, filed on Apr. 12, 2001.

(51) Int. Cl.[7] ..... B22C 1/22

(52) U.S. Cl. ..... 164/526; 164/15; 164/16; 164/529; 523/139; 523/145; 523/427; 523/436; 523/438; 523/466

(58) Field of Search ..... 164/15, 16, 526, 164/529; 523/139, 145, 427, 436, 438, 466

(56) References Cited

U.S. PATENT DOCUMENTS

| | | | | |
|---|---|---|---|---|
| 4,518,723 A | | 5/1985 | Woodson | 523/466 |
| 4,526,219 A | | 7/1985 | Dunnavant et al. | 164/16 |
| 4,806,576 A | * | 2/1989 | Woodson | 523/139 |

* cited by examiner

*Primary Examiner*—Robert Dawson
*Assistant Examiner*—D. Aylward
(74) *Attorney, Agent, or Firm*—David L. Hedden

(57) ABSTRACT

This invention relates to erosion resistant foundry binder systems, which will cure in the presence of sulfur dioxide and a free radical initiator, comprising (a) an epoxy resin; (b) a multifunctonal acrylate; (c) a phenolic resin that is soluble in (a) and (b); and (d) an effective amount of a free radical initiator. The foundry binder systems are used for making foundry mixes. The foundry mixes are used to make foundry shapes (such as cores and molds) which are used to make metal castings.

14 Claims, No Drawings

EROSION-RESISTANT COLD-BOX FOUNDRY BINDER SYSTEMS

CROSS-REFERENCE TO RELATED APPLICATIONS

This application is a utility application based upon provisional application No. 60/283,488 filed on Apr. 12, 2001.

CLAIM TO PRIORITY

Applicants claim the priority date of provisional application serial No. 60/283,488 filed on Apr. 12, 2001, which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to erosion resistant foundry binder systems, which will cure in the presence of sulfur dioxide and a free radical initiator, comprising (a) an epoxy resin; (b) a multifunctonal acrylate; (c) a phenolic resin that is soluble in (a) and (b); and (d) an effective amount of a free radical initiator. The foundry binder systems are used for making foundry mixes. The foundry mixes are used to make foundry shapes (such as cores and molds) which are used to make metal castings.

(2) Description of the Related Art

In the foundry industry, one of the procedures used for making metal parts is "sand casting". In sand casting, disposable molds and cores are fabricated with a mixture of sand and an organic or inorganic binder. The foundry shapes are arranged in casting assembly, which results in a cavity through which molten metal will be poured. After the molten metal is poured into the assembly of molds and cores and cools, the metal part formed by the process is removed from the assembly. The binder is needed so the molds and cores will not disintegrate when they come into contact with the molten metal.

Two of the prominent fabrication processes used in sand casting are the no-bake and the cold-box processes. In the no-bake process, a liquid curing catalyst is mixed with an aggregate and binder to form a foundry mix before shaping the mixture in a pattern. The foundry mix is shaped by putting it into a pattern and allowing it to cure until it is self-supporting and can be handled. In the cold-box process, a gaseous curing catalyst is passed through a shaped mixture (usually in a corebox) of the aggregate and binder to cure the mixture.

The core or mold produced from the binder must maintain its dimensional accuracy during the pouring of the metal, but disintegrate after the metal cools, so that it can be readily separated from the metal part formed during the casting process. Otherwise, time consuming and labor intensive means must be utilized to break down the binder so the metal part can be removed from the casting assembly. This is particularly a problem with internal cores, which are imbedded in the casting assembly and not easily removed.

U.S. Pat. No. 4,526,219 discloses a cold-box process for making foundry shapes, whereby certain ethylenically unsaturated materials are cured by a free radical mechanism in the presence of a free radical initiator and vaporous sulfur dioxide. Typically, these binders are packaged in two parts. The Part I and Part II of the binder are mixed with a foundry aggregate, typically sand, to form a foundry mix. The total amount of binder used to form the foundry mix is typically from about 0.5 to 2 weight percent based on sand (bos). The foundry mixed is blown or compacted into a pattern where it is gassed with $SO_2$ to produce a cured core or mold. Foundry mixes made with these binders have extended benchlife and foundry shapes made with the binder have excellent physical properties.

This binder system, currently sold by Ashland Specialty Chemicals Division, a division of Ashland Inc., under the trademark "ISOSET", has been in use approximately 18 years. The multifunctional acrylate most commonly used is trimethylolpropane triacrylate. The hydroperoxide most commonly used is cumene hydroperoxide. Though the binder has been used successfully in many foundry applications, the cores produced with binder often erode when the hot molten metal is poured over them. Erosion occurs when molten metal contacts the mold or core surface during the pouring process and sand is dislodged from the core at the point of contact. This occurs because the binder does not have sufficient heat resistance to maintain surface integrity until the pouring process is complete. The result is that sand is carried into the metal casting, creating weak areas in the casting. A dimensional defect is also created on the surface of the casting.

In order to reduce core erosion, foundries have historically coated the cores with refractory coatings. Core and mold assemblies are dipped into or sprayed with a slurry composed of a high-melting refractory oxide, a carrier such water or alcohol, and thixotropic additives. When dried on the mold/core surface, the coating prevents erosion in most cases. The problem with using coatings that is that the coating operation is messy, requires expensive gas fired, microwave, or radiant energy ovens to dry the wash onto the core surface, and can itself cause casting defects if the wash is not properly dried.

U.S. Pat. No. 4,518,723 discloses binders, cured with sulfur dioxide and in the presence of a free radical curing agent, which additionally contain an epoxy resin. These binders are also packaged as two-part binders. One part (Part I) is a mixture of a bisphenol-A epoxy resin (bisphenol-F epoxy resin is also used, but not as commonly) and cumene hydroperoxide (free radical initiator). The other part (Part II) is a mixture of a bisphenol-A epoxy resin, a multifunctional acrylate, and optional components. The Part I and Part II of the binder are mixed with a foundry aggregate, typically sand, to form a foundry mix. Examples VI, VII, and VIII of this patent describe a binder containing a base-catalyzed phenolic resole resin. These base-catalyzed phenolic resole resins are not benzylic ether phenolic resole resins, which are prepared with a divalent metal catalyst.

The binder disclosed in Examples VI, VII, and VIII of the '723 patent was a mixture composed of 80% Epon 828 (a bisphenol-A epoxy resin), 10% phenolic resin, and 10% methanol. This blend was then divided into three parts and modified 20% with trimethylolpropane triacrylate, furfuryl methacrylate, and furfuryl glycidyl ether, respectively. Cumene hydroperoxide was added at 30% based on the weight of the resin composition, and standard tensile specimens were cured with sulfur dioxide. The examples demonstrated that the described compositions made usable cores.

The purpose of using the base-catalyzed phenolic resole resin in these examples was to provide a low-cost reactive diluent that would also polymerize in the presence of the acid generated by the sulfur dioxide and cumene hydroperoxide. Although this purpose was accomplished, several problems existed with this binder. Though the binders containing the base-catalyzed phenolic resole resin produced adequate strength, long-term stability of the compositions was a problem. First, the base catalyzed resoles (sodium hydroxide or lithium hydroxide catalyzed), prepared at a basic pH (pH 8.5–9.0), contained a high percentage of reactive methylol groups, which made the resin highly polar and not very soluble in epoxy resins. This necessitated the use of a polar solvent (methanol) which caused odor and flash-point problems in actual foundry practice. Secondly, the reactive methylol groups tended to self-condense during storage of the compositions, generating water which made the phenolic less soluble and shortened the effective storage life of the binder.

Also, these base-catalyzed phenolic resole resins could not be dehydrated without gelling. The lowest water content that could be achieved was about 4%, compounding the solubility problem and requiring that substantial amounts of methanol or ethanol be added to the formulation to co-solubilize the water. These alcohols lowered the flash point of the mixture substantially, and would have required a flammable label for shipping and storage. It was also discovered that this type of resole had an inhibiting effect on the polymerization of trimethylolpropane triacrylate, an essential ingredient in most formulations, and though the binder containing the base-catalyzed phenolic resole resin would still produce useful cores, better tensile strength performance in the cores and molds, as evidenced by standard tests, was obtained without it's inclusion. Because of these problems, phenolic resole-modified compositions for this process were never commercialized. Furthermore, enhanced erosion resistance of cores made with these binders was never observed.

BRIEF SUMMARY OF THE INVENTION

The subject invention relates to foundry binder systems, which cure in the presence of vaporous sulfur dioxide and a free radical initiator, comprising:

(a) 20 to 70 parts by weight of an epoxy resin;

(b) 15 to 50 parts by weight of a monomeric or polymeric acrylate monomer;

(c) from 2 to 20 parts by weight a phenolic resin that is soluble in (a) and (b); and (d) an effective amount of a hydroperoxide, where (a), (b), (c), and (d) are separate components or mixed with another of said components, provided (b) is not mixed with (d), and where said parts by weight are based upon 100 parts of binder.

The foundry binders are used for making foundry mixes. The foundry mixes are used to make foundry shapes, such as cores and molds, which are used to make metal castings.

Preferably the epoxy resin is a bisphenol F epoxy resin or a mixture of a bisphenol F epoxy resin and an epoxy novolac resin. If a mixture of a bisphenol F epoxy resin and an epoxy novolac resin is used, the weight ratio of bisphenol F epoxy resin to epoxy novolac resins is from 90:10 to 10:90, preferably from 80:20 to 30:70.

Preferably the phenolic resole resin is a benzylic ether phenolic resole resin, most preferably an alkoxy-modified benzylic ether phenolic resole resin. The phenolic resins used in the binder are preferably totally soluble in epoxy resins and multifunctional acrylates, and the binders are preferably storage stable.

The addition of minor amounts the phenolic resole to the binder, particularly in combination with the bisphenol F and/or epoxy novolac resin, improves the erosion resistance of cores and molds made with the binders. Erosion resistance is increased to the point where either a coating is not required for iron castings, or a reduced coating thickness or a less expensive coating is required.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All units are in the metric system and all percentages are percentages by weight unless otherwise specified.

An epoxy resin is a resin having an epoxide group, i.e.,

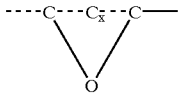

wherein x is zero or a whole number, typically from 1 to 4, such that the epoxide functionality of the epoxy resin is equal to or greater than 2.0, typically from 2.3 to 3.5. Although an epoxy resin may contain some monomeric bisphenol A and bisphenol F, the term "epoxy resin" should not be construed as pure monomeric bisphenol A and bisphenol F, which have an epoxide functionality of 2.0.

Examples of epoxy resins include (1) diglycidyl ethers of bisphenol A, B, F, G and H, (2) halogen-substituted aliphatic epoxides and diglycidyl ethers of other bisphenol compounds such as bisphenol A, B, F, G, and H, and glycidyl ethers of phenolic-aldehyde novolacs (epoxy novolacs) which have an epoxide functionality greater than 2, and (3) mixtures thereof. Epoxy resins (1) are made by reacting epichlorohydrin with the bisphenol compound in the presence of an alkaline catalyst. By controlling the operating conditions and varying the ratio of epichlorohydrin to bisphenol compound, products of different molecular weight can be made. Epoxy resins of the type described above based on various bisphenols are available from a wide variety of commercial sources.

Examples of epoxy resins (2) include halogen-substituted aliphatic epoxides, diglycidyl ethers of other bisphenol compounds such as bisphenol A, B, F, G, and H, and epoxy novolac resins. Examples of halogen-substituted aliphatic epoxides include epichlorohydrin, 4-chloro-1, 2-epoxybutane, 5-bromo-1, 2-epoxypentane, 6-chloro-1, 3-epoxyhexane and the like.

Preferably the epoxy resin is a bisphenol F epoxy resin or a mixture of a bisphenol F epoxy resin and an epoxy novolac resin. The "epoxy novolac resins" used in the binder are less commonly known and used than other epoxy resins. Examples of epoxy novolac resins include epoxy cresol and epoxy phenol novolacs, which are produced by reacting a novolac resin (usually formed by the reaction of orthocresol or phenol and formaldehyde) with epichlorohydrin, 4-chloro-1, 2-epoxybutane, 5-bromo-1,2-epoxypentane, 6-chloro-1, 3-epoxyhexane and the like. The epoxy novolac resins, used in the binders, have an average epoxide functionality of at least 2.1 to 3.5, preferably from about 2.3 to about 3.0. Particularly preferred are epoxy novolacs having an average weight per epoxy group of 165 to 200. Although the viscosities of the epoxy novolac resins are high, usually greater than 5,000 cps at 25° C., the epoxy component viscosity is reduced to a workable level when the epoxy novolac resin is mixed with the free radical initiator and/or solvent.

If a mixture of a bisphenol F epoxy resin and a an epoxy novolac resins is used, the weight ratio of bisphenol F epoxy resin to epoxy novolac resin is from 90:10 too 10:90, preferably from 80:20 to 30:70.

The free radical initiator (b) is a peroxide and/or hydroperoxide. Examples include ketone peroxides, peroxy ester free radical initiators, alkyl oxides, chlorates, perchlorates, and perbenzoates. Preferably, however, the free radical initiator is a hydroperoxide or a mixture of peroxide and hydroperoxide. Hydroperoxides particularly preferred in the invention include t-butyl hydroperoxide, cumene hydroperoxide, paramenthane hydroperoxide, etc. The organic peroxides may be aromatic or alkyl peroxides. Examples of useful diacyl peroxides include benzoyl peroxide, lauroyl peroxide and decanoyl peroxide. Examples of alkyl peroxides include dicumyl peroxide and di-t-butyl peroxide.

Cumene hydroperoxide and/or a multifunctional acrylate, such as trimethylolpropane triacrylate, may be added to the epoxy novolac resin before mixing it with the foundry aggregate. Optionally, a solvent or solvents may be added to reduce system viscosity or impart other properties to the binder system such as humidity resistance. Examples of solvents include aromatic hydrocarbon solvents, such as such as o-cresol, benzene, toluene, xylene, ethylbenzene, and naphthalenes; reactive epoxide diluents, such as glycidyl ether; or an ester solvent, such as dioctyl adipate, rapeseed methyl ester, and the like, or mixtures thereof. If a solvent is used, sufficient solvent should be used so that the resulting viscosity of the epoxy resin component is less than 1,000 centipoise, preferably less than 400 centipoise. Generally, however, the total amount of solvent is used in an amount of 0 to 25 weight percent based upon the total weight of the epoxy resin.

The reactive unsaturated acrylic monomer, polymer, or mixture thereof (c) contains ethylenically unsaturated bonds. Examples of such materials include a variety of monofunctional, difunctional, trifunctional, tetrafunctional and pentafunctional monomeric acrylates and methacrylates. A representative listing of these monomers includes alkyl acrylates, acrylated epoxy resins, cyanoalkyl acrylates, alkyl methacrylates, cyanoalkyl methacrylates, and difunctional monomeric acrylates. Other acrylates, which can be used, include trimethylolpropane triacrylate, methacrylic acid and 2-ethylhexyl methacrylate. Typical reactive unsaturated acrylic polymers, which may also be used include epoxy acrylate reaction products, polyester/urethane/acrylate reaction products, acrylated urethane oligomers, polyether acrylates, polyester acrylates, and acrylated epoxy resins.

Although solvents are not required for the reactive diluent, they may be used. Typical solvents used are generally polar solvents, such as liquid dialkyl esters, e.g. dialkyl phthalate of the type disclosed in U.S. Pat. No. 3,905,934, and other dialkyl esters such as dimethyl glutarate. Methyl esters of fatty acids, particularly rapeseed methyl ester, are also useful solvents. Suitable aromatic solvents are benzene, toluene, xylene, ethylbenzene, and mixtures thereof. Preferred aromatic solvents are mixed solvents that have an aromatic content of at least 90% and a boiling point range of 138° C. to 232° C. Suitable aliphatic solvents include kerosene. Although the components can be added to the foundry aggregate separately, it is preferable to package the epoxy novolac resin and free radical initiator as a Part I and add to the foundry aggregate first. Then the ethylenically unsaturated material, as the Part II, either alone or along with some of the epoxy resin, is added to the foundry aggregate.

Although it is believed that any phenolic resin, which is soluble in the epoxy resin and acrylate, including based catalyzed phenolic resole resins and novolac resins, will provide some improvement in erosion resistance, the preferred phenolic resole resins are benzylic ether phenolic resole resins, most preferably alkoxy-modifed benzylic ether phenolic resole resins. Benzylic ether phenolic resole resins are prepared by reacting an excess of aldehyde with a phenol in the presence of a divalent metal catalyst. Benzylic ether phenolic resole resins, or alkoxylated versions thereof, are well known in the art, and are specifically described in U.S. Pat. Nos. 3,485,797 and 4,546,124, which are hereby incorporated by reference. These resins contain a preponderance of bridges joining the phenolic nuclei of the polymer, which are ortho-ortho benzylic ether bridges. They are prepared by reacting an aldehyde and a phenol in a mole ratio of aldehyde to phenol of at least 1:1 in the presence of a metal ion catalyst, preferably a divalent metal ion such as zinc, lead, manganese, copper, tin, magnesium, cobalt, calcium, and barium.

The phenols used to prepare the phenolic resole resins include any one or more of the phenols which have heretofore been employed in the formation of phenolic resins and which are not substituted at either the two ortho-positions or at one ortho-position and the para-position. Such unsubstituted positions are necessary for the polymerization reaction. Any one, all, or none of the remaining carbon atoms of the phenol ring can be substituted. The nature of the substituent can vary widely and it is only necessary that the substituent not interfere in the polymerization of the aldehyde with the phenol at the ortho-position and/or para-position. Substituted phenols employed in the formation of the phenolic resins include alkyl-substituted phenols, aryl-substituted phenols, cyclo-alkyl-substituted phenols, aryloxy-substituted phenols, and halogen-substituted phenols, the foregoing substituents containing from 1 to 26 carbon atoms and preferably from 1 to 12 carbon atoms.

Specific examples of suitable phenols include phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, and p-phenoxy phenol. Multiple ring phenols such as bisphenol A are also suitable.

The aldehyde used to react with the phenol has the formula RCHO wherein R is a hydrogen or hydrocarbon radical of 1 to 8 carbon atoms. The aldehydes reacted with the phenol can include any of the aldehydes heretofore employed in the formation of phenolic resins such as formaldehyde, acetaldehyde, propionaldehyde, furfuraldehyde, and benzaldehyde. In general, the aldehydes employed have the formula RCHO wherein R is hydrogen or a hydrocarbon radical of 1 to 8 carbon atoms. The most preferred aldehyde is formaldehyde.

Although not necessarily preferred, the benzylic ether phenolic resole resin may contain a solvent, such as an aromatic hydrocarbon solvent such as benzene, toluene, xylene, ethylbenzene, naphthalenes, or an ester solvent, such as rapeseed methyl ester, or mixtures thereof, and the like. If a solvent is used, sufficient solvent should be used so that the resulting viscosity of the Part I is less than 1,000 centipoise, preferably less than 400 centipoise. Generally, however, the total amount of solvent is used in an amount of 0 to 25 weight percent based upon the total weight of the Part I.

Typically, the amounts of the components used in the binder system are from 20 to 70 weight percent of epoxy novolac resin, preferably from 35 to 60 weight percent; to 25 weight percent of free radical initiator, preferably from 15 to 20 weight percent; and 15 to 50 weight percent of multi-functional acrylate, preferably from 15 to weight percent, from 5 to 20 parts of benzylic ether phenolic resole resin, where the weight percent is based upon 100 parts of the binder system.

It will be apparent to those skilled in the art that other additives such as silanes, silicones, benchlife extenders, release agents, defoamers, wetting agents, etc. can be added to the aggregate, or foundry mix. The particular additives chosen will depend upon the specific purposes of the formulator.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used are known to those skilled in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sands, and the like.

In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

The foundry mix is molded into the desired shape by ramming, blowing, or other known foundry core and mold making methods. The shape is then cured almost instantaneously by the cold-box process, using vaporous sulfur dioxide as the curing agent (most typically a blend of nitrogen, as a carrier, and sulfur dioxide containing from 35 weight percent to 65 weight percent sulfur dioxide), described in U.S. Pat. Nos. 4,526,219 and 4,518,723, which are hereby incorporated by reference. The shaped article is preferably exposed to effective catalytic amounts of 100 percent vaporous sulfur dioxide, although minor amounts of a carrier gas may also be used. The exposure time of the sand mix to the gas is typically from 0.5 to 3 seconds. Although the foundry shape is cured after gassing with sulfur dioxide, oven drying is needed if the foundry shape is coated with a refractory coating.

The core and/or mold may be formed into an assembly. When making castings, the assembly is typically coated with a water-based refractory coating and passed through a conventional or microwave oven to remove the water from the coating. The item is then ready to be handled for further processing.

Abbreviations

The abbreviations used in the examples are as follows:

| | |
|---|---|
| Bis A epoxy resin | epoxy resin prepared from bisphenol A having an average molecular weight of about 340 and a functionality of about 1.9. |
| Bis F epoxy resin | epoxy resin prepared from bisphenol F having an average molecular Weight of about 340 and a functionality of about 2.0. |
| CHP | cumene hydroperoxide (9.0% active oxygen). |
| DOA | dioctyl adipate. |
| EEW | epoxide equivalent weight. |
| EPN 8250 | an epoxy novolac with 2.5 functionality, EEW 170–175, Viscosity 25,000 cps @ 25° C. |
| EPN 8330 | an epoxy novolac with 3.5 functionality, EEW 170–175, Viscosity 500,000 cps @ 25° C. |
| HI-Sol 15 | aromatic solvent. |
| RESIN = | a mixture of a benzylic ether phenolic resole resin prepared with zinc acetate dihydrate as the catalyst and modified with the addition of 0.09 mole of methanol per mole of phenol, prepared along the lines described in the examples of U.S. Pat. No. 3,485,797, and 20 weight percent of dibasic ester solvent based on the weight of the benzylic ether phenolic resole resin. |
| TMPTA | trimethyolpropane triacrylate, an unsaturated monomer. |

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application, all units are in the metric system and all amounts and percentages are by weight, unless otherwise expressly indicated.

The components of the Part I and Part II of the binder were blended for 3 minutes using a Hobart sand mixer. Test wedge cores, weighing 4 pounds, were prepared by adding 1.0 weight percent of the binder (the Part I was added first) to 2000 grams of Manley 1L5W, such that the ratio of Part I/Part II was 1:1, blowing the mixture into a metal wedge pattern, gassing it 50% sulfur dioxide in nitrogen for 1.5 seconds, and then purging with air for 10 seconds.

The shape of the erosion wedge and a diagram of the test method are shown in FIG. 7 of "Test Casting Evaluation of Chemical Binder Systems", W L Tordoff et al, AFS Transactions, 80-74, (pages 152–153), developed by the British Steel Casting Research Association. According to this test, molten iron (1480° C.) is poured through a pouring cup into a 1" diameter×16 " height sprue, where it ran down the sprue, impinged upon the wedge-shaped test mold at an angle of 60°, and ran into a sand vented reservoir.

When the mold cavity was full, pouring was stopped and the specimen allowed to cool. When cool, the erosion test wedge was removed and the erosion rating determined. If erosion has occurred, it shows up as a protrusion on the slant side of the test wedge.

Resistance to erosion was evaluated based on the results of the tests and the uncoated cores made with the binders. The severity of the erosion is indicated by assigning a numerical rating: 1=Excellent, 2=Good, 3=Fair, 4=Poor, 5=Very poor. This a very severe erosion test. A rating of 1 or 2 generally implies excellent erosion resistance in actual foundry practice, if the same refractory/binder type and ratio are used. A rating of 3 or higher indicates that a coating is needed. In some tests where erosion is particularly severe, a rating of 5+ may be given, indicating off-scale erosion.

Example A

The two-part binder used in Example A is based on bis A epoxy resin. It does not contain any epoxy novolac, bis F epoxy, or benzylic ether phenolic resole resin. The composition of the binder is described as follows:

Part I:
grams of Bis-A epoxy
35 parts CHP.

Part II:
53.7 grams of Bis-A epoxy
45.7 grams TMPTA
0.6 gram coupling agent.

Example 1

Example A was repeated, except the Part II of the binder was modified to include a benzylic ether phenolic resole resin (RESIN). The binder formulation is described as follows:

Part I:
65 grams of Bis-A epoxy
35 parts CHP.

Part II:
42.42 grams of Bis-A epoxy
36.1 grams TMPTA
0.6 gram coupling agent.
21.0 grams of RESIN Example B The binder in this example contained an epoxy novolac and bisphenol F, but did not contain a benzylic ether phenolic resole resin. The formulation is as follows:

Part I:
30 grams of cumene hydroperoxide (CHP)
52.5 grams of bis-F epoxy resin,
17.5 grams of EPN 8330.

Part I:
50.76 grams TMPTA
25.38 Bis-A epoxy
17.63 DOA
5.71 HiSol 15
0.5 coupling agent.

Example 2

Example B was repeated, except the binder was modified to include a benzylic ether phenolic resole resin. The binder formulation is as follows:

Part I:
30 grams of cumene hydroperoxide (CHP)
52.5 grams of bis-F epoxy resin,
17.5 grams of EPN 8330.

Part I:
40.0 grams TMPTA
20.0 bis-A epoxy
13.9 DOA
4.5 HiSol 15
0.5 coupling agent.
21.0 RESIN The erosion test results of the wedge cores made with the binders of Examples A, B, 1, and 2 are set forth in Table I which follows:

TABLE I

| Core Example | Erosion Rating |
|---|---|
| A | 5+ (very poor) |
| 1 | Somewhat improved |
| B | 4.5 (poor) |
| 2 | 1.5 (excellent) |

Comparison Examples A and Example 1 demonstrate that binders containing predominantly bisphenol-A epoxy resin, as the epoxy resin component, show some improvement in erosion resistance when the benzylic ether phenolic resole resin is added.

In Example B, the binder contained an epoxy novolac and bisphenol F, but did not contain any benzylic ether phenolic resole resin. Again, the erosion resistance was poor. However, Example 2, which contained the benzylic ether phenolic resole resin, as well as the epoxy novolac and bisphenol F, produced cores that showed a dramatic increase in erosion resistance. In an actual foundry trial, which used the binder of Example 2 to make cores, cast iron intake manifolds could be poured without coating the cores. When using a binder system identical to comparison Example A, which was the customer's standard binder system, a coating was required for the cores.

Example C

A commercial base catalyzed resole, CR492, is a phenol-formaldehyde resole catalyzed with potassium hydroxide, with a formaldehyde to phenol molar ratio of approximately 1.2 to 1. It contains approximately 17% water and 10% free phenol. This is the same phenolic resole used in examples VI, VII, and VIII in Woodson U.S. Pat. No. 4,518,723. The resin was vacuum distilled to a water level of 3.5%.

Example 2 was repeated except that the above base-catalyzed resole was substituted for the benzylic ether resole in Part II. The phenolic resin was not soluble in this formulation, nor was it soluble in the TMPTA or any practical combination of epoxy resin/TMPTA or epoxy resin/TMPTA/DOA/HiSol 15. This resin was considered impractical for a two-part binder system.

Example 3

Example 2 was repeated except that Bisphenol-F epoxy resin was substituted in place of the bis A epoxy in the Part II. A test wedge core was made and placed in the test mold, and tested as previously described. The test wedge was given a rating of 1.5 (excellent). This Example illustrates that improvements in erosion resistance result when bis A epoxy resin is used instead of bis F epoxy resin in the formulation.

Example 4

Example 2 was repeated except that Bisphenol-F epoxy was substituted in place of the EPN 8330 epoxy novolac in Part I. A test wedge core was prepared and tested as previously described. The test wedge was given a rating of 2.0 (Good).

Example D

A phenol-formaldehyde novolac resin with a phenolic hydroxyl functionality of approximately 3.6, containing less than 0.1% water and 0.05% phenol, was substituted for the benzylic ether resole in Part II of Example 2. It was necessary to heat the Part II formulation to 60 C and add the novolac gradually to effect solution. The viscosity of this mixture was undesirably high; 1000 cps @ 25 C. A test wedge core was prepared and evaluated as previously described. The test wedge was given a rating of 2.5 (Good).

The result of Example 6 indicates that it is possible to employ a multifunctional phenol-formaldehyde novolac to increase erosion resistance in this system; desirably, a novolac with lower viscosity but with adequate functionality to impart increased erosion resistance to this system.

What is claimed is:

1. A foundry binder system, which will cure in the presence of sulfur dioxide and a free radical initiator, comprising:

(a) 20 to 70 parts by weight of an epoxy resin comprising an epoxy resin selected from the group consisting of (1) an epoxy novolac, (2) bisphenol F, and mixtures thereof;

(b) 15 to 50 parts by weight of a monomeric or polymeric acrylate;

(c) from 2 to 20 parts by weight a benzlyic ether phenolic resole resin; and (d) an effective amount of a peroxide, where (a), (b), (c), and (d) are separate components or mixed with another of said components, provided (b) is not mixed with (d), and where said parts by weight are based upon 100 parts of binder.

2. The binder system of claim 1 wherein the epoxy resin is a mixture of bis F epoxy resin and an epoxy novolac resin having a functionality of about 2.3 to about 3.0.

3. The binder system of claim 2 wherein the weight ratio of bis F epoxy resin to epoxy novolac resin is from 90:10 to 10:90.

4. The binder system of claim 3 wherein the phenolic resin is an alkoxy-modified phenolic resole resin.

5. The binder system of claim 4 wherein the acrylate is a monomer and the monomer is trimethyolpropane triacrylate and the peroxide is a hydroperoxide.

6. The binder system of claim 5 wherein the hydroperoxide is cumene hydroperoxide.

7. The binder system of claim 6 wherein the phenolic resole resin is used neat.

8. The binder system of claim 7 where (a) also contains (b) and/or (c).

9. The binder system of claim 8 which contains no bisphenol A resin.

10. A foundry mix comprising:

(a) a major amount of foundry aggregate;

(b) an effective bonding amount of the foundry binder system of claim 1, 3, 4, 5, 6, 7, 8, or 9.

11. A cold-box process for preparing a foundry shape comprising:

(a) introducing the foundry mix of claim 10 into a pattern; and (b) curing with vaporous sulfur dioxide.

12. A foundry shape prepared in accordance with claim 11.

13. A process of casting a metal article comprising:

(a) fabricating an uncoated foundry shape in accordance with claim 12;

(b) pouring said metal while in the liquid state into said coated foundry shape;

(c) allowing said metal to cool and solidify; and (d) then separating the molded article.

14. A casting prepared in accordance with claim 13.

* * * * *